US005240107A

United States Patent [19]

Casale

[11] Patent Number: 5,240,107

[45] Date of Patent: Aug. 31, 1993

[54] RAZOR HOLDER WITH SHAVE COUNTER

[76] Inventor: James Casale, 245 E. 84th St., Apt. 8E, New York, N.Y. 10028

[21] Appl. No.: 984,334

[22] Filed: Dec. 2, 1992

[51] Int. Cl.[5] ..... A45D 27/29

[52] U.S. Cl. ..... 206/354; 30/40.2; 30/41.7; 206/349; 206/459.1; 340/568

[58] Field of Search ..... 30/40, 40.2, 41.7; 206/349, 351, 354, 355, 459.1; 340/540, 568, 691

[56] References Cited

U.S. PATENT DOCUMENTS

| | | | |
|---|---|---|---|
| 2,697,276 | 12/1954 | Austin | 30/40.2 |
| 3,633,089 | 1/1972 | Dorion, Jr. | 206/351 |
| 4,729,472 | 3/1988 | Lubin et al. | 206/459.1 |
| 4,870,405 | 9/1989 | Fletcher | 340/568 |
| 5,062,209 | 11/1991 | Rais | 30/41.7 |

*Primary Examiner*—Jimmy G. Foster

*Attorney, Agent, or Firm*—Abdallah & Muckelroy

[57] ABSTRACT

A razor holder having an automatic shave counter responsive to each use of a razor. The razor holder includes a delay circuit to permit short term use of a razor without advancing the counter.

10 Claims, 5 Drawing Sheets

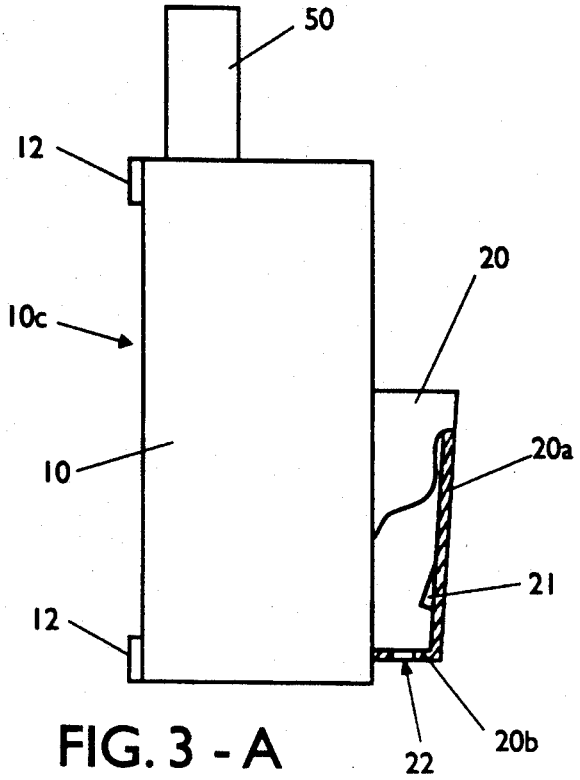
FIG. 3 - A
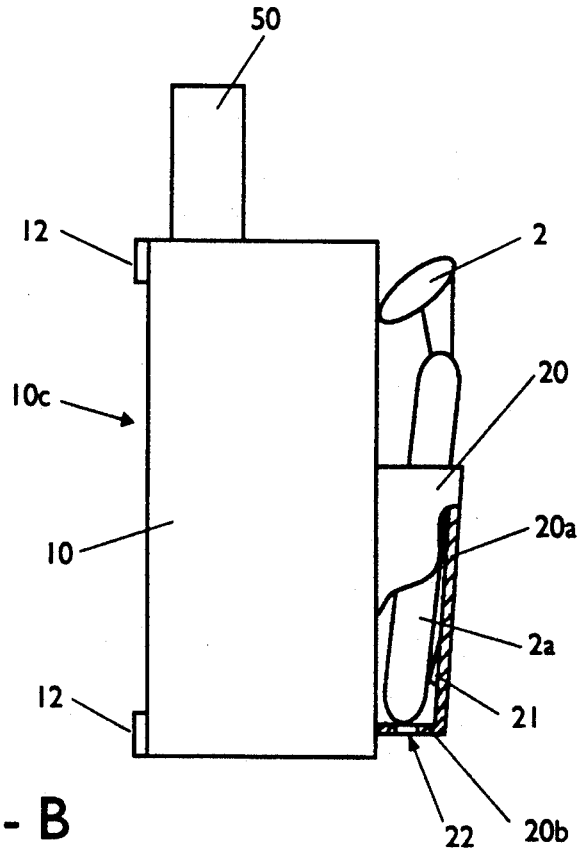
FIG. 3 - B

RAZOR HOLDER WITH SHAVE COUNTER

BACKGROUND OF THE INVENTION

The present invention generally relates to holders for safety razors. More particularly, this invention relates to a holder for safety razors that includes shave counting means to indicate when a razor blade should be replaced.

Continued use of a razor results in the razor blade becoming dull. A dull razor tends to nick the face and therefore it is desirable to change the blade in a safety razor before it becomes sufficiently dull to cause problems. The number of times that a razor blade can be used before becoming too dull for safe use varies with the brand of the razor and/or blade, and the skin of the particular user. Thus, the number of safe uses of a razor blade is personal to the individual. Though the number of safe uses of a razor blade can be determined through experience, maintaining in memory an accurate, ongoing count of the number of uses of a razor blade is difficult, if not impossible. Therefore, there is a need in the art for automatic shave counting means to indicate when a razor blade is too dull for safe use.

Various shave counting means have been disclosed in the prior art. These prior art shave counters are generally constructed having the shave counting means formed in the structure of the razor. This limits the user's choices to particular razors. However, a razor holder that includes shave counting means permits the use of a wide variety of razors and therefore is preferred.

An exemplary prior art razor including shave counting means is disclosed in U.S. Pat. No. 3,476,077 to Henkel wherein an indexing disk is disposed in the handle of the razor and is rotated by the user after each shave. U.S. Pat. No. 3,618,563 to Singer discloses a safety razor with shave counting means disposed in the razor handle that is likewise manually operated after each use. U.S. Pat. No. 4,112,271 to Marchetti discloses an electric shaver having counting means controlled by the operation of the shaver on/off switch. A razor guard that includes counting means is shown in U.S. Pat. No. 3,394,456 to Gatz wherein the counter is automatically advanced each time the guard is removed from the head of the razor.

U.S. Pat. No. 3,633,089 to Dorion et al. discloses a holder for battery-powered safety razors that includes battery charging means automatically activated upon placement of a razor in the holder.

SUMMARY OF THE INVENTION

The present invention is a razor holder generally comprising a holder main body, a razor receptacle fixedly attached to the holder main body, a counter switch disposed in the razor receptacle and activated by removal of a razor from the razor receptacle, a numerical display or counter operably communicating with the counter switch, and a razor blade cartridge holder formed in the holder main body for storage of replacement blades. The counter switch includes a delay circuit which permits removal of the razor from the razor receptacle for a short period without advancing the counter.

An object of the present invention is to provide a razor holder for storage of a safety razor between uses.

Another object of this invention is to provide a razor holder that automatically determines and records the number ofi uses of a razor blade.

A further object of this invention is to prevent the inadvertent use of a dull razor blade.

A still further object of this invention is to provide for efficient use of replaceable razor blades.

Another object of the present invention is to provide a razor holder having blade storage means.

It is also an object of this invention to provide a shave counter that includes a delay circuit that permits short term use of a razor for touch up and the like without advancing the shaver counter.

These and other objects and advantages of the present invention will be apparent to those skilled in the art from the following description of preferred embodiments, claims and appended drawings.

BRIEF DESCRIPTION OF THE DRAWINGS

FIG. 3-A is a partially fragmented side elevational view of the first embodiment of the razor holder.

FIG. 3-B is a partially fragmented side elevational view similar to that shown in FIG. 3-A illustrating activation of the shave counting means switch by a razor handle.

DESCRIPTION OF A PREFERRED EMBODIMENT

Figure 1:
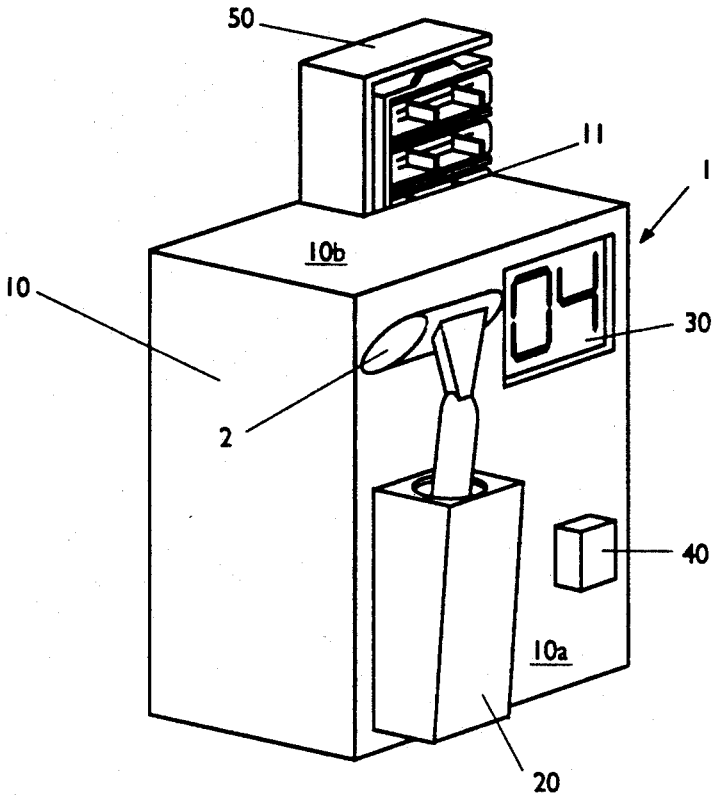
FIG. 1 is a front perspective view of a first preferred embodiment of a razor holder constructed in accordance with the teachngs of the present invention.

FIG. 1 illustrates in a front perspective view a first preferred embodiment of a razor holder 1 constructed in accordance with the teachings of the present invention. First razor holder 1 generally comprises a holder main body 10, a razor receptacle 20 fixedly attached to a forward face 10*a* of holder main body 10, a numerical counter display 30 and a display reset button 40 disposed on the forward face 10*a* of holder main body 10, and a razor blade cartridge holder 50 selectively receivable in a cartridge cavity 11 formed in a top wall 10*b* of holder main body 10. A safety razor 2 is selectively receivable in the razor receptacle 20. The placement of razor 2 into razor receptacle 20 progressively advances counter display 30 as hereinafter described in greater detail.

Figure 2:
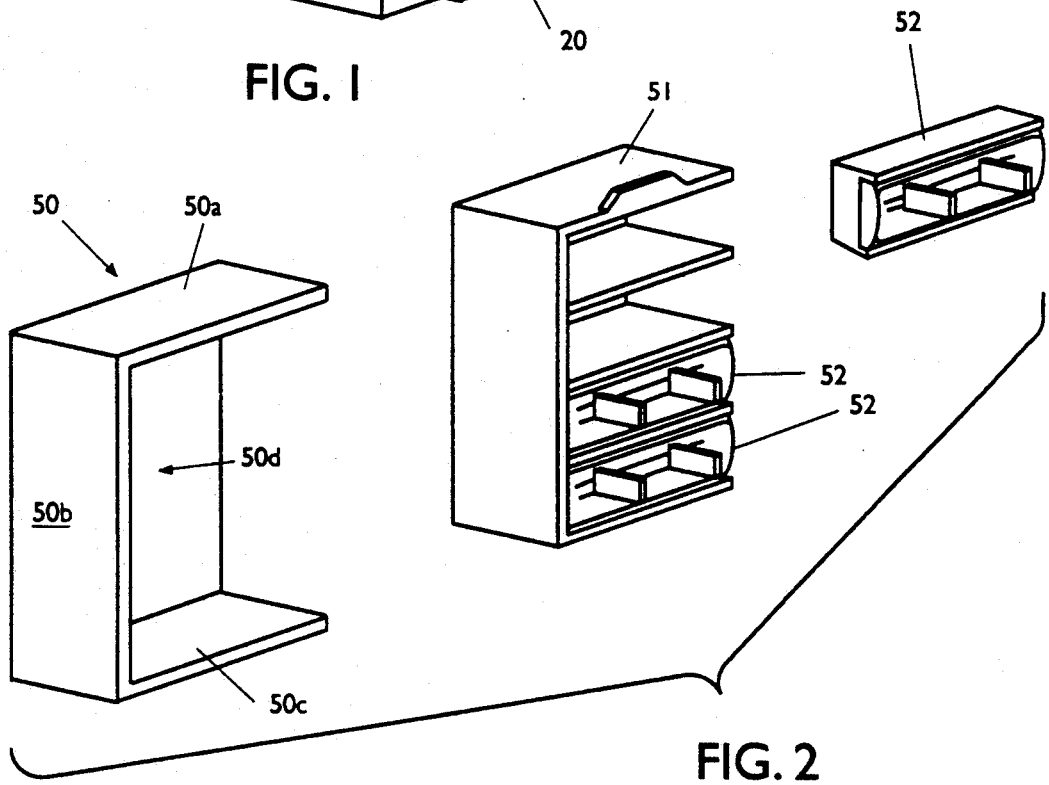
FIG. 2 is an exploded perspective view illustrating the cartridge holder of the first embodiment for storage of replacement razor blades.

Referring now to the exploded perspective view in FIG. 2, razor blade cartridge holder 50 can be seen formed as substantially a recessed quadrilateral having a closed top wall 50*a*, a closed first side wall 50*b*, closed bottom wall 50*c* and an open second side wall 50*d*. A plurality of replaceable razor blades 52 for a safety razor 2 are generally marketed and sold in a blade storage cartridge 51. For storage of replacement blades 51 in first razor holder 1 blade storage cartridge 51 is receivable in cartridge holder 50 through the open second side wall 50*d*. Razor cartridge holder 50 is slidably receivable in the cartridge cavity 11. The top wall 50*a* of razor cartridge holder 50 extends flush with the top wall 10*b* of holder main body 10 when cartridge holder 50 is disposed in a closed position.

FIGS. 3-A and 3-B, fragmented side elevational views of first razor holder 1, illustrate wall attachment means 12 for selective affixation of first razor holder 1 to a bathroom wall, shower wall or the like. Wall attachment means 12 generally comprises a glue strip disposed on the rearward face 10*c* of holder main body 10, or may alternatively comprise suction cups. As should be understood, first razor holder 1 may also include footings (not shown) formed on the bottom wall 10*d* of holder main body 10 for upright support upon a horizontal surface such as a bathroom sink.

As also can be seen in FIGS. 3-A and 3-B, razor receptacle 20 includes a counter display switch 21 disposed on an interior portion of receptacle 20, preferably on the receptacle side wall 20*a*. Counter display switch 21 is preferably an outwardly-biased returnable spring switch. As illustrated in FIG. 3-B when a safety razor 2 is disposed in razor receptacle 20, the handle 2*a* of razor 2 depresses counter display switch 21. Thereby numerical counter display 30 is advanced each time safety razor 2 is placed into razor receptacle 20. The number of uses of a razor blade 52 can thus be visually displayed to retain an automatic count of the uses of blade and avoid using a dull blade. It can also be seen that razor receptacle 20 includes a drainage opening 22 formed in the receptacle floor 20*b* to permit the release of water from first razor receptacle 20 that may cling to a safety razor 2.

Figure 4:
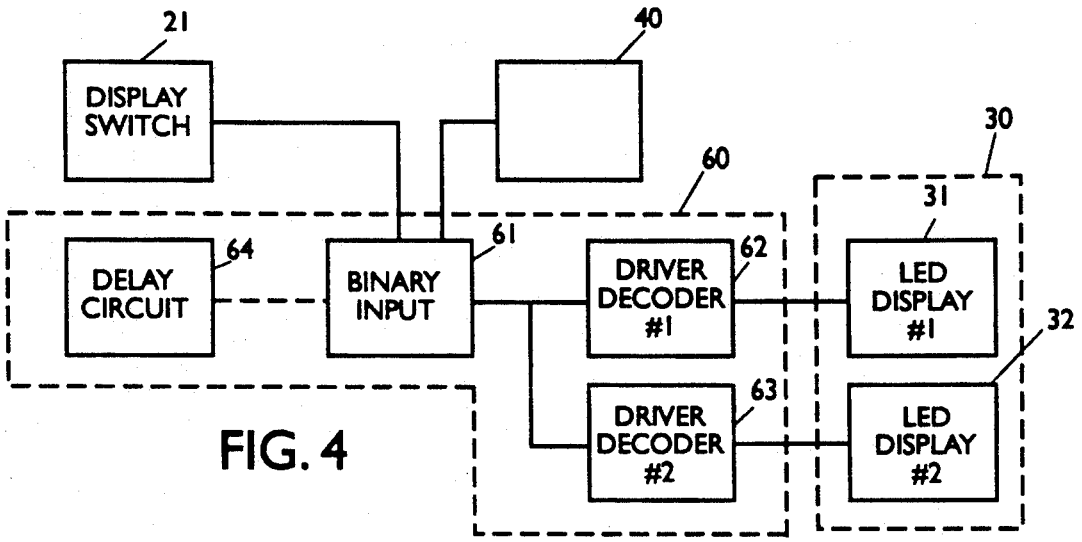
FIG. 4 is a block diagram of the electronic components in the razor holder of the present invention.
Figure 5:
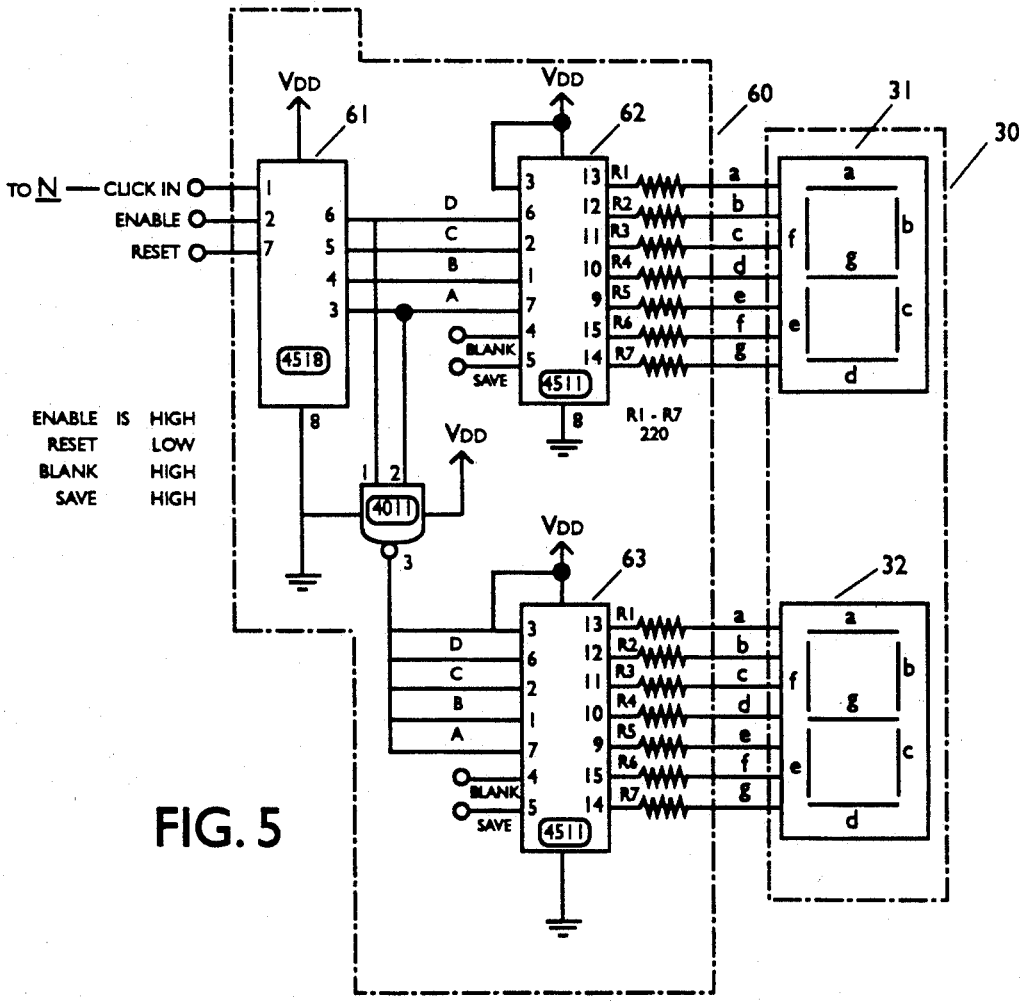
FIG. 5 is a schematic diagram of the electronic circuitry for the razor holder.

FIG. 4 illustrates in a block diagram the basic electronic circuit elements in the razor holder 1 of the present invention. The circuitry for razor holder 1 generally includes counter display switch 21, counter reset button switch 40, numerical counter display 30, and counter display control means 60 connected between the counter display switch 21 and the counter display 30. Counter display 30 preferably comprises first and second light-emitting diodes displays 31, 32 of the type commonly known in the art. Counter display control means 60 includes a binary input circuit 61 connected to respective first and second driver/decoder units 62, 63. The respective first and second driver/decoder units 62, 63 control operation of the respective first and second light-emitting diodes displays 31, 32 for display of the number of activations of display switch 21. Counter display control means 60 may alternatively further include a delay circuit 64 connected to the binary input circuit 61 to delay the advancing of counter display 30 for short term use of a razor 2 for touch ups and the like.

In the schematic diagram illustrated in FIG. 4 it can be seen that the electrical circuitry for the razor holder 1 of the present invention can be constructed by using commercially-available electronic components. Numerical counter 30 comprises two cathode LED displays 31, 32. Driver/decoder units 62, 63 comprise individual "4511" integrated circuits interconnected through a "NAND" gate, herein shown as a "4011" integrated circuit, and the first and second driver/decoder units 62, 63 are respectively connected to the respective cathode LED displays 31, 32. Binary input circuit 61 comprises a commonly-available "4518" integrated circuit.

Figure 6:
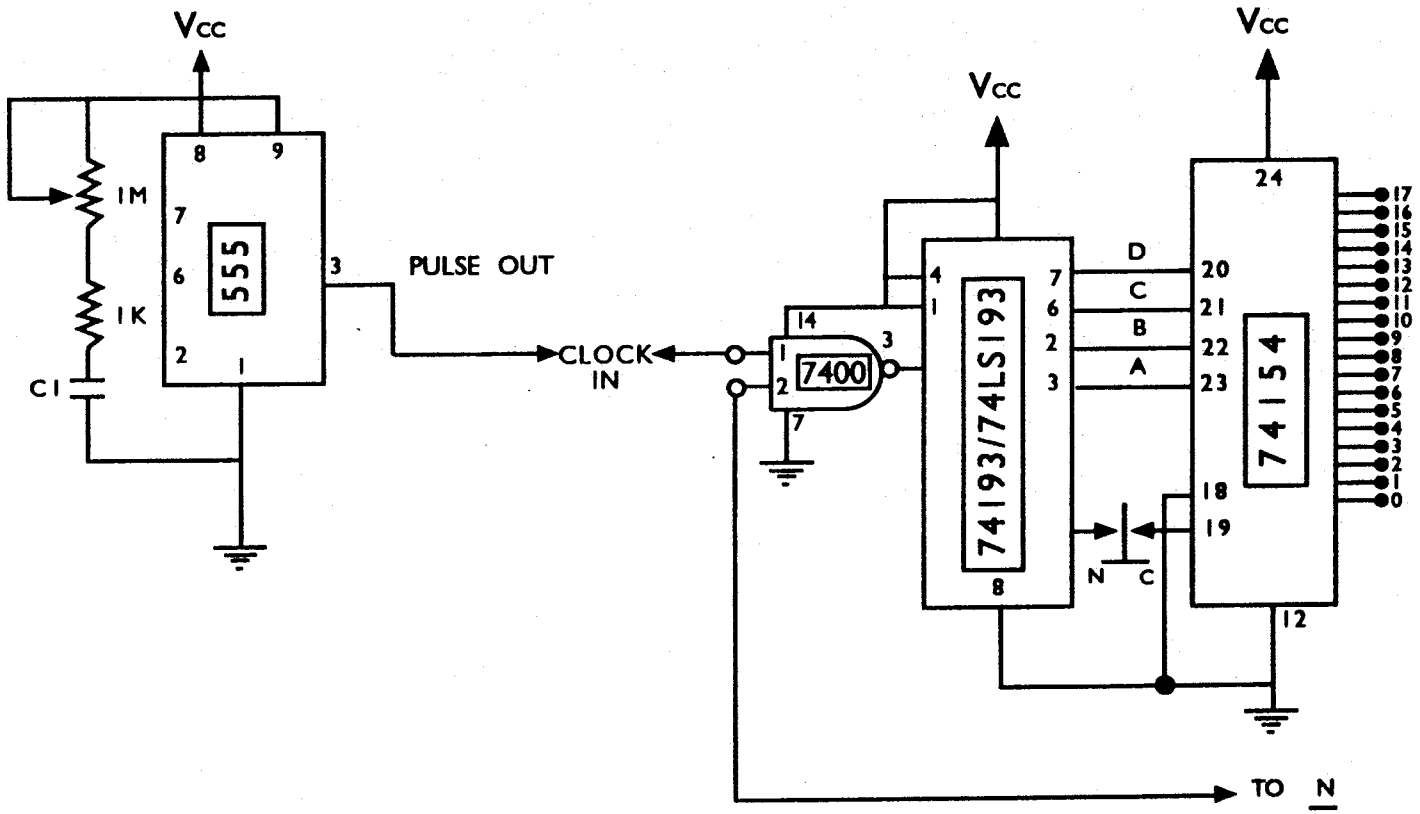
FIG. 6 is a schematic diagram of the electronic circuity for a delay circuit for the razor holder of the present invention.

A schematic diagram of a suitable delay circuit 64 is illustrated in FIG. 6. Similarly, delay circuit 64 can be constructed from commercially-available electronic components. Delay circuit 64 delays the activation of the binary input circuit 61 and the advancing of the numerical counter display 30 for a predetermined period, preferably 15–20 seconds. The delay in advancing of the numerical counter display 30 permits use of the razor 2 for short periods of time for touch ups and the like, as heretofore mentioned.

Figure 7:
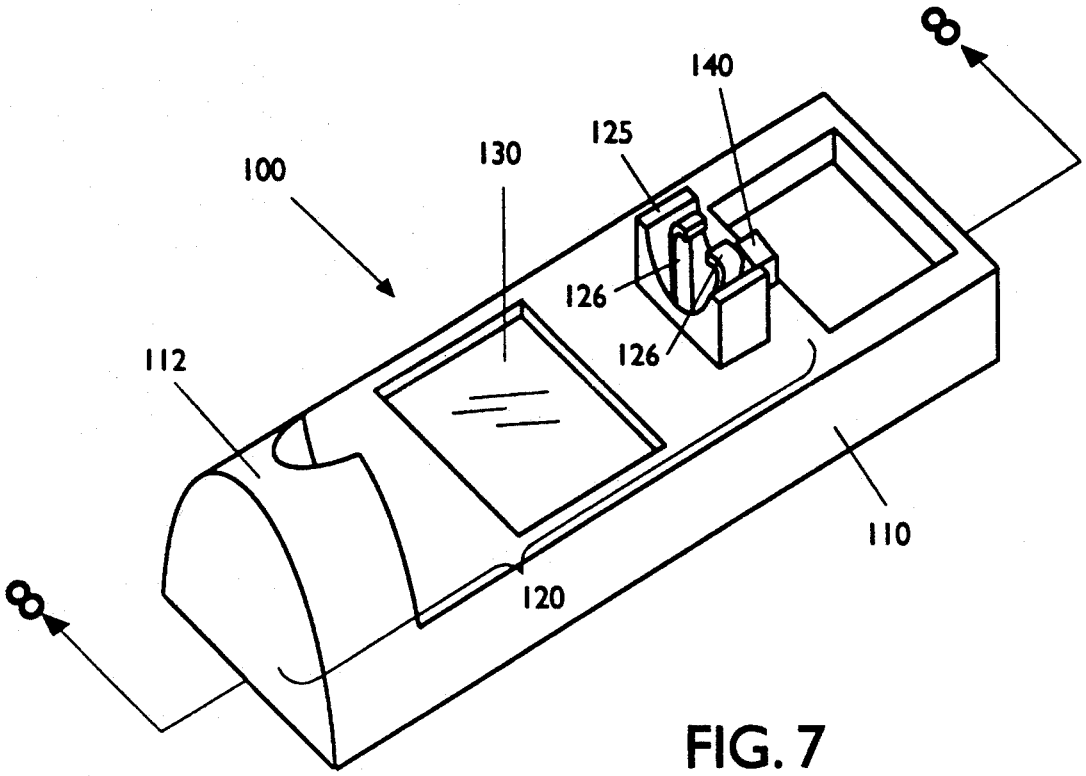
FIG. 7 is a perspective view of a second preferred embodiment of a razor holder in accordance with the teachings of the present invention.

FIG. 7 illustrates in a top perspective view a second preferred embodiment of the razor holder 100 of the present invention. Second razor holder 100 is configured similar to packaging in which razor blades 52 and razors 2 are presently marketed. Second razor holder 100 generally includes a second main body 110 selectively attachable to a main body support 111, a second razor receptacle 120 formed in the second main body 110, a second counter display 130 disposed in the second main body 110, and a second reset button 140 also disposed in the second main body 110. Second razor receptacle 120 generally comprises a seat 121 formed in a first raised portion 112 at an end of second main body 110, and a handle neck clip 125 forwardly disposed from the first raised portion 112. A razor 2 is receivable in second razor receptacle 120 by engaging the foot 2*a*′ of the razor handle 2*a* in the seat 121 of first raised portion 112 and the upward portion of the razor handle 2*a* in the handle neck clip 125.

Figure 8:
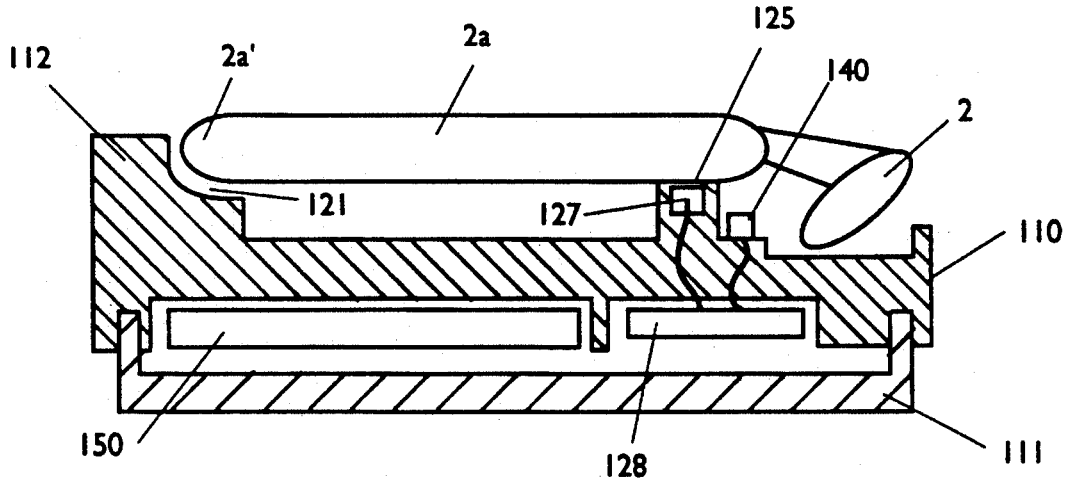
FIG. 8 is a cross-sectional elevational view of the second preferred embodiment of the razor holder.

Razor neck clip 125 preferably comprises lateral clipping arms 126 pivotally mounted in second holder main body 110 which selectively activate a second display switch 127 (FIG. 8) disposed in second holder main body 110. Second display switch 127, as well as reset button switch 140, are connected to a special purpose integrated circuit 128 to perform the functions heretofore described for advancing the second numerical counter display 130. A razor blade storage cartridge 51 can be stored in a second cartridge receptacle 150 formed in the second holder main body 110.

Various changes, additions and modifications may be made to the preferred embodiments of the present invention without departing from its spirit and scope. Such changes, additions and modifications within a fair reading of the claims are intended as a part of the present disclosure.

Therefore, in view of the foregoing I claim:

1. A razor holder having a shave counter, said razor holder comprising razor support means;

shave counter means disposed in said razor support means;

counter display means connected to the shave counter means; and a shave counter means switch connected to the shave counter means, said switch being activated to selectively advance the shave counter means and the counter display means by engagement of a razor in the razor support means.

2. A razor holder as in claim 1 wherein said razor support means comprises a holder main body, a razor receptacle attached to the holder main body, a numerical counter display disposed on the holder main body, a display reset button connected to the shave counter means switch and disposed on the holder main body, said shave counter means switch being disposed in the razor receptacle.

3. A razor holder as in claim 2 wherein said shave counter means switch is an outwardly-biased spring switch attached to a side wall of the razor receptacle, said switch being selectively activated by engagement of a handle portion of the razor.

4. A razor holder as in claim 2 further including a fluid drain formed in a portion of the razor receptacle.

5. A razor holder as in claim 2 further including wall attachment means disposed on a rearward portion of the holder main body.

6. A razor holder as in claim 2 further including a razor blade cartridge holder disposed in the main body of the razor holder.

7. A razor holder as in claim 6 wherein said cartridge holder is selectively receivable in said main body.

8. A razor holder as in claim 2 further including a delay switching means connected to the counter display switch.

9. A razor holder as in claim 1 wherein said razor support means comprises a razor holder base, a razor holder support frame selectively disposable onto said holder base, razor handle clipping means formed in the holder support frame, a numerical counter display means disposed in the holder support frame, and a counter display means reset button disposed in the holder support frame.

10. A razor holder having an automatic shave counter comprising a holder main body comprising a formed plastic tray having a first raised portion at an end of the holder main body and a handle neck clip forwardly disposed from the first raised portion, said first raised portion having a seat formed therein, a razor being receivable in the seat and handle neck clip of the holder main body;

switching means disposed in the handle neck clip and activated by receipt of a razor in said handle neck clip;

a numerical counter display;

an integrated circuit to advance the numerical counter display in response to activation of the switching means; and numerical counter reset means to reset the numerical counter display.

* * * * *